US006511631B2

(12) United States Patent
Kuniyoshi et al.

(10) Patent No.: US 6,511,631 B2
(45) Date of Patent: Jan. 28, 2003

(54) POWDER COMPACTING APPARATUS AND METHOD OF PRODUCING A RARE-EARTH MAGNET USING THE SAME

(75) Inventors: Futoshi Kuniyoshi, Nishinomiya (JP); Koki Tokuhara, Hyogo (JP); Kunitoshi Kanno, Toyooka (JP); Hitoshi Morimoto, Hyogo (JP); Tomoiku Ohtani, Yao (JP); Ryoji Ono, Takatsuki (JP)

(73) Assignee: Sumitomo Special Metals Co., Ltd. (JP)

( * ) Notice: Subject to any disclaimer, the term of this patent is extended or adjusted under 35 U.S.C. 154(b) by 10 days.

(21) Appl. No.: 09/838,546

(22) Filed: Apr. 20, 2001

(65) Prior Publication Data

US 2002/0001534 A1 Jan. 3, 2002

(30) Foreign Application Priority Data

Apr. 21, 2000 (JP) ..... 2000-120268

(51) Int. Cl.[7] ..... B22F 3/00
(52) U.S. Cl. ..... 419/38; 419/30
(58) Field of Search ..... 419/38, 30; 425/78

(56) References Cited

U.S. PATENT DOCUMENTS 4,813,818 A * 3/1989 Sanzone ..... 141/250
5,858,415 A * 1/1999 Bequette et al. ..... 425/258
5,881,357 A * 3/1999 Takemoto et al. ..... 222/1
5,945,135 A * 8/1999 Beane et al. ..... 425/260
6,183,232 B1 * 2/2001 Bequette et al. ..... 425/258
6,299,832 B1 * 10/2001 Kohara et al. ..... 419/38
6,321,800 B1 * 11/2001 Ogawa et al. ..... 141/100

FOREIGN PATENT DOCUMENTS

| | | |
|---|---|---|
| JP | 57-124599 | 8/1982 |
| JP | 63-033505 | 2/1988 |
| JP | 63-110521 | 7/1988 |
| JP | 06-346102 | 12/1994 |
| JP | 10-321451 | 12/1998 |

OTHER PUBLICATIONS

Specifications and Drawings for application Ser. No. 09/472,247, "Process and Apparatus for Supplying Rare Earth Metal–Based Alloy Powder", Filing Date: Dec. 27, 1999, Inventors: Seiichi Kohara et al.
Specifications and Drawings for application Ser. No. 09/702,130, Method for Manufacturing Rare Earth Magnet, Filing Date: Oct. 31, 2000, Inventors: Futoshi Kuniyoshi et al.

* cited by examiner

*Primary Examiner*—Ngoclan Mai
(74) *Attorney, Agent, or Firm*—Jeffrey L. Costellia; Nixon Peabody LLP

(57) ABSTRACT

The present invention aims to prevent heating and ignition of a material powder of a rare-earth alloy while reducing the oxygen content thereof so as to improve the magnetic properties of the rare-earth magnet. A rare-earth alloy powder is compacted by using a powder compacting apparatus including: an airtight container capable of storing a rare-earth alloy powder therein; an airtight feeder box moved between a powder-filling position and a retracted position; and an airtight powder supply device capable of supplying the rare-earth alloy powder from the container into the feeder box without exposing the rare-earth alloy powder to the atmospheric air.

8 Claims, 3 Drawing Sheets

POWDER COMPACTING APPARATUS AND METHOD OF PRODUCING A RARE-EARTH MAGNET USING THE SAME

FIELD OF THE INVENTION

The present invention relates to a method of producing an R—Fe—B type rare-earth magnet. More specifically, the present invention relates to a powder compacting apparatus that is particularly suitable for use with a rare-earth alloy powder having a reduced oxygen content, and a method of producing a rare-earth magnet using the same.

BACKGROUND OF THE INVENTION

A rare-earth alloy sintered magnet is made by compacting a magnetic powder that has been obtained by pulverizing a rare-earth alloy, and then subjecting the product to a sintering step and an aging step. Currently, two types of rare-earth alloy sintered magnets are widely used in various fields: samarium-cobalt magnets and neodymium-iron-boron magnets. Particularly, neodymium-iron-boron magnets (hereinafter referred to as "R—Fe—B magnets", wherein R denotes a rare-earth element and/or Yttrium, Fe denotes iron, and B denotes boron.) have been actively employed in various electronic devices because they exhibit the highest magnetic energy product among various magnets and are relatively inexpensive. An R—Fe—B magnet is primarily composed of a major phase of an $R_2Fe_{14}B$ tetragonal compound, an R-rich phase of Nd, or the like, and a B-rich phase. Part of Fe may be substituted with a transitional metal such as Co or Ni, and part of B may be substituted with C.

In the prior art, such a rare-earth alloy has been made by an ingot casting method in which a material molten alloy is put in a mold and cooled at a relatively slow rate. An alloy made by the ingot casting method is crushed and pulverized through a known pulverization process. The obtained alloy powder is then compacted by any of various powder compacting apparatuses, and then transferred into a sintering chamber, where the compact (green compact) of the alloy powder undergoes a sintering step.

In recent years, rapid cooling methods such as a strip casting method and a centrifugal casting method have been attracting public attention, in which a molten alloy is contacted with a single roll, a pair of rolls, a rotating disc, a rotating cylindrical mold, or the like, so as to be cooled at a relatively high rate, thereby making a solidified alloy that is thinner than an alloy ingot. The rapidly cooled alloy thus obtained has a thickness of 0.03–10 mm. In an exemplary rapid cooling process, a chill roll in contact with a molten alloy is rotated so that the molten alloy is picked up by the roll in the form of a thin sheet on the roll surface. The solidification of the sheet of molten alloy on the chill roll starts from the plane along which the molten alloy contacts the chill roll ("roll contact plane"), wherein a columnar crystal starts growing from the roll contact plane in a direction perpendicular to the roll contact plane. As a result, a rapidly cooled alloy made by a strip casting method, or the like, has a composition containing an $R_2T_{14}B$ crystal phase (wherein T denotes iron and/or a transition metal element substituting part of iron with Co, or the like) whose size in the short axis direction is between 0.1 $\mu$m and 100 $\mu$m and whose size in the long axis direction is between 5 $\mu$m and 500 $\mu$m, and an R-rich phase that exists dispersed along the grain boundaries of the $R_2T_{14}B$ crystal phase. The R-rich phase is a non-magnetic phase having a relatively high concentration of rare-earth element R, and has a thickness (equivalent to the width of the grain boundary) less than or equal to 10 $\mu$m.

A rapidly cooled alloy is made at a higher cooling rate ($10^2$–$10^{4\circ}$ C./sec) as compared with an alloy ingot made by a conventional ingot casting method (mold casting method), and therefore has advantageous characteristics such as a fine structure and a small crystal grain diameter. A rapidly cooled alloy is also advantageous in that it has a desirable R-rich phase dispersion as it has a large grain boundary area and the R-rich phase can exist thinly dispersed along the grain boundaries.

However, a magnetic powder of a rapidly-cooled alloy such as a strip-cast alloy is easily oxidized. It is believed that this is because the R-rich phase, which is easily oxidized, is likely to appear on the grain surface of a powder of a rapidly-cooled alloy. A powder of a rapidly-cooled alloy is very easily heated and ignited. Even if oxidization stops short of igniting the powder, the magnetic properties of the powder deteriorate significantly due to the oxidization.

While the heating and ignition of the rare-earth component due to oxidization occur also when compacting a rare-earth alloy powder that has been made by a conventional ingot casting method, the problem is more pronounced when compacting a powder of a rapidly-cooled alloy such as a strip-cast alloy.

In addition to the problem described above, the oxidization of a rare-earth alloy powder also causes a problem as follows.

It is known that the magnetic properties of an R—Fe—B magnet can be improved by increasing the content of the major phase, i.e., the $R_2Fe_{14}B$ tetragonal compound. While a minimum amount of R-rich phase is required for a liquid phase sintering process, R also reacts with oxygen to produce an oxide, $R_2O_3$, whereby part of R is consumed for a purpose that has no contribution to sintering. Accordingly, an extra amount of R is required for the consumption by oxidization. The production of the oxide $R_2O_3$ increases as the amount of oxygen in the powder-making atmosphere increases. In view of this, attempts have been made in the prior art to reduce the amount of oxygen in the powder-making atmosphere and to reduce the relative amount of R in the final R—Fe—B magnet product, thereby improving the magnetic properties thereof.

Although it is preferred to reduce the amount of oxygen in a rare-earth alloy powder that is used to produce an R—Fe—B magnet, as described above, the method of reducing the amount of oxygen in a rare-earth alloy powder to improve the magnet properties has not been realized as a mass-producing technique for the following reason. When an R—Fe—B alloy powder is made under a controlled environment with a reduced oxygen concentration so that the amount of oxygen in the alloy powder is reduced to be less than or equal to 4000 mass parts per million (ppm), for example, the powder may violently react with the oxygen in the atmosphere and may ignite within a few minutes at room temperature. Thus, although it was understood that it would be preferred to reduce the amount of oxygen in the rare-earth alloy powder in order to improve the magnetic properties thereof, it was actually difficult to handle a rare-earth alloy powder with such a reduced oxygen concentration at a manufacturing site such as a plant.

Particularly, in a pressing step for compacting a powder, the temperature of the compact increases due to the frictional heat that is generated between powder particles being compacted and/or the frictional heat that is generated between the powder and the inner wall of the cavity when the compact is taken out of the cavity, thereby increasing the risk of ignition.

It has been proposed in the art to perform a compaction process in an inert gas atmosphere in order to suppress such an oxidization as disclosed in, for example, Japanese Laid-Open Patent Publication No. 6-346102, which describes providing an airtight gas chamber which accommodates at least compacting apparatus including a pressing section and a powder supply section for supplying a powder to a powder feeding device.

However, the conventional compacting apparatus is uneconomical because the gas chamber has a relatively large volume, thereby requiring a large amount of inert gas to fill the gas chamber. In the conventional compacting apparatus, the inert gas is not supplied directly to the rare-earth alloy powder, and the space around the passageway via which the rare-earth alloy powder (or the compact) is transferred (e.g., the space around the powder feeding device) is also exposed to a high concentration of inert gas, thereby failing to effectively utilize the inert gas.

Moreover, in cases where the inside of the gas chamber is frequently exposed to the air atmosphere (e.g., where die replacement is frequently needed for making various types of compacts), the use of the conventional apparatus significantly reduces the productivity as it requires a long period of time for substituting the gas in the gas chamber with an inert gas each time a die is replaced by another.

Moreover, although the pressing step with a compacting apparatus is automated, the compacting apparatus requires frequent maintenance, and such maintenance often requires a human operator. If the compacting apparatus is placed in an inert atmosphere, an operator who comes close to the compacting apparatus for trouble shooting may suffer from atmospheric hypoxia. For these and other reasons, placing the entire compacting apparatus in an inert atmosphere is not a practical approach.

In the prior art, a liquid lubricant such as a fatty acid ester is added to a fine powder prior to the pressing step in order to improve the compressibility of the powder. Although such addition of a liquid lubricant forms a thin oily coating on the surface of the powder particles, it cannot sufficiently prevent the oxidization of the powder when a powder whose oxygen concentration is less than or equal to 4000 mass ppm is exposed to the atmospheric air.

In view of this, in the prior art, a slight amount of oxygen is intentionally introduced into the atmosphere during pulverization of a rare-earth alloy so as to slightly oxidize the surface of the finely pulverized powder, thereby reducing the reactivity thereof. For example, Japanese Patent Publication for Opposition No. 6-6728 discloses a technique of using a supersonic flow of an inert gas containing a predetermined amount of oxygen to finely pulverize a rare-earth alloy while forming a thin oxidized coating on the particle surface of the fine powder produced through the pulverization. With the technique, oxygen in the atmospheric air is blocked by the oxidized coating formed on the powder particle surface, thereby preventing the heating and ignition of the powder due to oxidization. However, the presence of the oxidized coating on the powder particle surface increases the total amount of oxygen contained in the powder.

Japanese Laid-Open Patent Publication No. 10-321451 discloses a technique of mixing a low-oxygen R—Fe—B alloy powder with a mineral oil, or the like, to obtain a slurry. Since the powder particles in the slurry are not exposed to the atmospheric air, it is possible to prevent the heating and ignition of the alloy powder while reducing the amount of oxygen contained therein.

However, this conventional technique leads to a poor productivity because, after filling the cavity of the compacting apparatus with an R—Fe—B alloy powder in the form of a slurry, it is necessary to perform the pressing step while squeezing the oil component out of the alloy powder.

SUMMARY OF THE INVENTION

It is therefore an object of this invention to provide a practical method of producing a rare-earth magnet that exhibits desirable magnetic properties without causing an accidental ignition even when using a rare-earth alloy powder that is easily oxidized.

Another object of the present invention is to provide a method of producing a rare-earth magnet in a safe and efficient manner while using a rare-earth alloy powder having a low oxygen concentration.

An inventive powder compacting apparatus includes: an airtight container capable of storing a rare-earth alloy powder therein; an airtight feeder box moved between a powder-filling position and a retracted position; and an airtight powder supply device capable of supplying the rare-earth alloy powder from the container into the feeder box without exposing the rare-earth alloy powder to an atmospheric air.

In a preferred embodiment, the powder compacting apparatus further includes means for supplying an inert gas into the powder supply device, whereby an oxygen concentration in an atmosphere in each of the powder supply device and the feeder box during a pressing operation is controlled to be 50000 volume ppm or less.

In a preferred embodiment, the powder compacting apparatus further includes at least one gas concentration sensor for sensing the oxygen concentration in the powder supply device.

In a preferred embodiment, the powder compacting apparatus further includes at least one temperature sensor for sensing a temperature of the rare-earth alloy powder in the powder supply device.

In a preferred embodiment, the powder compacting apparatus further includes at least one temperature sensor for sensing a temperature of the rare-earth alloy powder in the feeder box.

In a preferred embodiment, the powder supply device includes a non-flexible hollow portion and a flexible hollow portion; and an open/close means is provided between the non-flexible hollow portion and the flexible hollow portion, wherein the open/close means is closed in response to an increase in the temperature of the rare-earth alloy powder.

In a preferred embodiment, at least a portion of the powder supply device is made of a flexible hollow portion; and the flexible hollow portion can flexibly deform as the feeder box is moved.

In a preferred embodiment, a screw feeder for moving the rare-earth alloy powder toward the flexible hollow portion at a controlled rate is provided in the non-flexible hollow portion of the powder supply device.

In a preferred embodiment, the flexible hollow portion of the powder supply device is made of a two-layer hose.

In a preferred embodiment, a device for vibrating the flexible hollow portion of the powder supply device so as to facilitate falling of the rare-earth alloy powder through the flexible hollow portion is attached to the flexible hollow portion.

In a preferred embodiment, the powder supply device includes a material receptacle for receiving the rare-earth alloy powder from the container; and a connection section including a valve capable of closing the material receptacle is provided between the container and the material receptacle.

In a preferred embodiment, the container is detachably connected to the connection section.

In a preferred embodiment, the feeder box includes a level sensor for sensing an upper surface level of the rare-earth alloy powder in the feeder box; and the rare-earth alloy powder is supplied into the feeder box by the powder supply device when the upper surface level of the rare-earth alloy powder in the feeder box has decreased below a predetermined level.

In a preferred embodiment, an inside of a powder supply passageway of the powder supply device is an inert gas atmosphere; and an outside of the powder supply passageway is an air atmosphere.

An inventive method is a method of producing a rare-earth magnet by performing a compaction process using the powder compacting apparatus as described above, the method including the steps of: storing a rare-earth alloy powder in the container; operating the powder supply device to supply the rare-earth alloy powder from the container into the feeder box without exposing the rare-earth alloy powder to the atmospheric air; and producing a compact by pressurizing the rare-earth alloy powder supplied from the feeder box into a predetermined space.

In a preferred embodiment, a rare-earth alloy powder whose oxygen content is 4000 mass ppm or less is compacted.

In a preferred embodiment, the method further includes the steps of: taking a compact made by the compacting apparatus out of the compacting apparatus and then impregnating the compact with an oil agent; and sintering the compact.

In a preferred embodiment, the method further includes the step of mixing the rare-earth alloy powder with a lubricant.

In a preferred embodiment, the rare-earth alloy powder is a dry powder.

Another inventive method of producing a rare-earth magnet includes the steps of: supplying a rare-earth alloy powder that has been produced through pulverization by a pulverization apparatus in which an oxygen concentration in a pulverization atmosphere is controlled to be 5000 volume ppm or less from the pulverization apparatus into an airtight container without exposing the rare-earth alloy powder to an atmospheric air; supplying the rare-earth alloy powder from the container into an airtight feeder box without exposing the rare-earth alloy powder to the atmospheric air; filling the rare-earth alloy powder from the feeder box into a cavity formed in a die of a compacting apparatus; and making a compact of the rare-earth alloy powder through a pressing process.

In a preferred embodiment, the rare-earth alloy powder is supplied from the container into the feeder box through a hollow structure having an inert atmosphere therein.

In a preferred embodiment, the step of making a compact is performed in an air atmosphere.

An embodiment of the inventive powder-filling device includes: a feeder box having an enclosure forming an airtight space for containing a powder therein; a level sensor for measuring an upper surface level of the powder contained in the space; and powder supply means for supplying the powder into the space based on an output from the level sensor.

In a preferred embodiment, the powder-filling device further includes stirring means provided in the space.

DESCRIPTION OF THE PREFERRED EMBODIMENTS

According to the present invention, a rare-earth alloy powder is supplied into a feeder box via a substantially sealed supply passageway in order to avoid exposing the powder to atmospheric air. As a result, it is possible to produce a rare-earth magnet that exhibits desirable magnetic properties without causing an accidental ignition even when employing a rare-earth alloy powder that is very easily oxidized (i.e., a low-oxygen powder).

An embodiment of the present invention will now be described with reference to the accompanying drawings.

Figure 1:
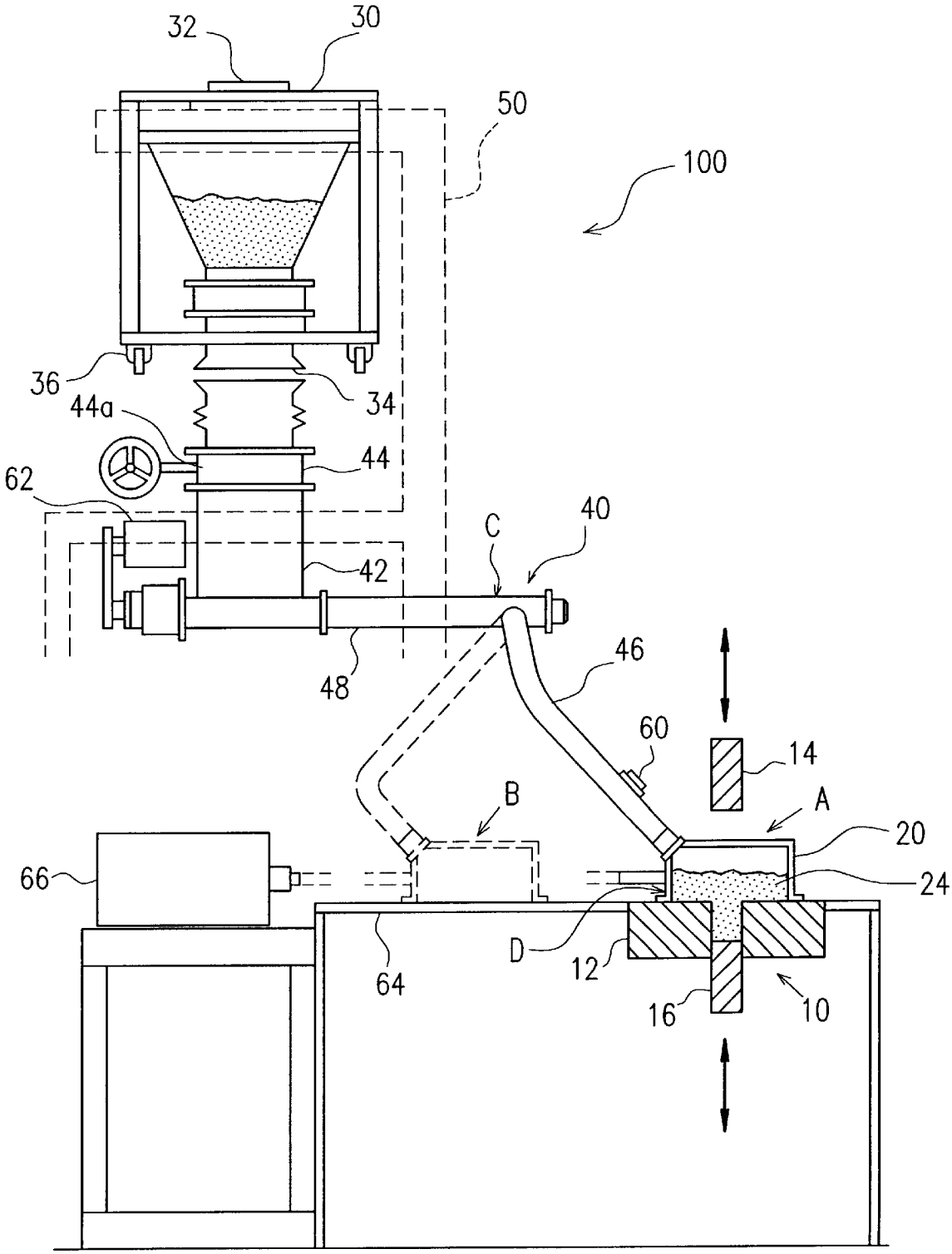
FIG. 1 is a diagram generally illustrating a powder compacting apparatus 100 according to one embodiment of the present invention.

FIG. 1 illustrates a main part of a powder compacting apparatus 100 of an embodiment of the present invention. The powder compacting apparatus 100 includes a die set 10 for performing a compaction process, a feeder box (powder-filling device)20 that is moved between a powder-filling position A and a retracted position B, and a container (material hopper) 30 capable of storing a rare-earth alloy powder therein.

The die set 10 of the compacting apparatus 100 is structurally similar to a conventional die set, and includes a die 12 having a through hole forming a cavity, and an upper punch 14 and a lower punch 16 to be inserted into the through hole of the die 12. While the die 12 is illustrated in FIG. 1 as having a single through hole for the sake of simplicity, the die 12 may alternatively have an array of through holes therein. A driving device (not shown) moves the die 12, the upper punch 14 and the lower punch 16 with respect to one another in a vertical direction to perform a pressing operation.

Distinctive features of the compacting apparatus 100 of the present embodiment include the feeder box 20 and the container 30 both being airtight with the inside thereof being substantially blocked from the ambient atmosphere, and a powder supply device 40 being provided for supplying a rare earth alloy powder from the container 30 into the feeder box 20 while preventing the rare earth alloy powder from being exposed to the atmospheric air. In the present embodiment, a powder supply passageway that is blocked from the atmospheric air extends from the container 30 to the feeder box 20, and the passageway is filled with an inert gas atmosphere.

With such a structure, it is possible to supply a rare-earth alloy powder to be compacted into the feeder box 20 as necessary without exposing the powder to the air atmosphere while keeping the atmosphere in the feeder box 20 inert. Therefore, it is possible to safely compact even a low-oxygen powder that is highly ignitable.

Moreover, the present embodiment employs a structure such that the container 30 can be detached from the compacting apparatus 100. By detaching the container 30 from the compacting apparatus 100 and connecting the container 30 to a pulverization apparatus system 200 (FIG. 2) to be described later, the container 30 can be filled with a rare-earth alloy powder that has been produced in the pulverization apparatus system 200 without exposing the rare-earth alloy powder to the air atmosphere.

Thus, according to the present embodiment, a series of steps, i.e., the pulverization step, the step of filling the container 30 with the rare-earth alloy powder, the step of supplying the powder into the feeder box 20, etc., are performed in a closed system without exposing the powder to the air atmosphere.

The structure of the container 30, the powder supply device 40, the feeder box 20, etc., will now be described in greater detail.

Figure 2:
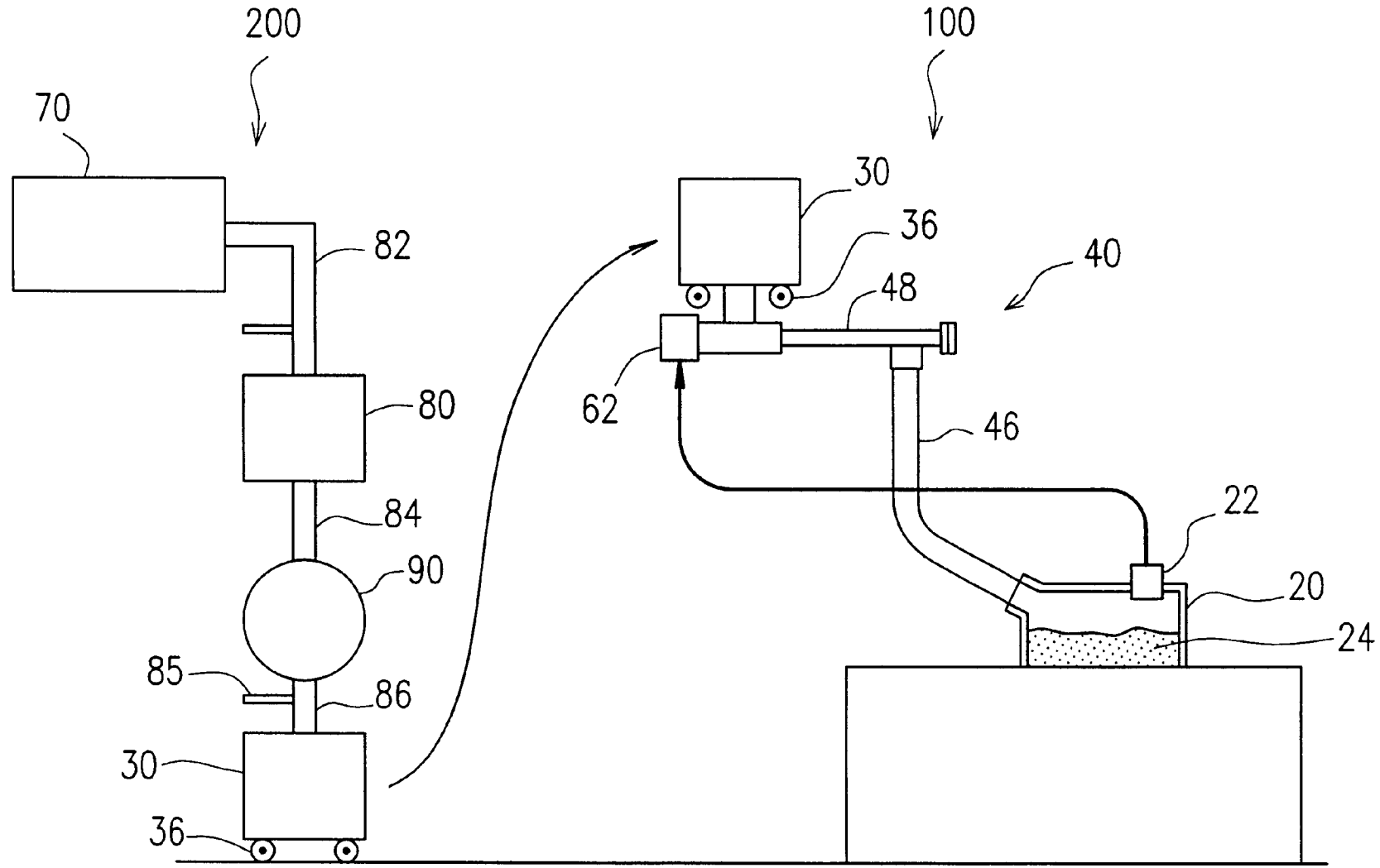
FIG. 2 is a diagram illustrating the powder compacting apparatus 100 and a pulverization apparatus system 200 according to an embodiment of the present invention.

The container 30 of the present embodiment is a highly airtight container with a sufficient space for storing a rare-earth alloy powder therein (the hopper capacity is, for example, 165 kg). An opening is provided at the top of the container 30 for receiving a rare-earth alloy powder from the pulverization apparatus system 200 (FIG. 2). The opening is closed in an airtight manner with a lid 32 after the container 30 is filled with a rare-earth alloy powder. Another opening 34 is provided at the bottom of the container 30 for passing the rare-earth alloy powder to the powder supply device 40 of the compacting apparatus 100. The opening 34 can be closed airtight with a ferrule.

The inner wall of the container 30 (the inner wall of the hopper) illustrated in FIG. 1 is sloped in a funnel-like shape, so that when the lower opening 34 is opened, the rare-earth alloy powder can easily exit the container 30 through the opening 34.

The container 30 is detachably supported by a support member 50 of the compacting apparatus 100. As the pressing step is repeated over time, the amount of rare-earth alloy powder remaining in the container 30 gradually decreases to zero. Then, the empty container 30 is replaced by another container (not shown) that is filled with a rare-earth alloy powder. The empty container 30 is moved to a position near the pulverization apparatus system 200 illustrated in FIG. 2, and is refilled with a rare-earth alloy powder from the pulverization apparatus system 200. In order to facilitate the reciprocal movement of the container 30 between the compacting apparatus 100 and the pulverization apparatus system 200, the container 30 is preferably provided with a number of wheels (casters) 36 suitable for such movement. Since the weight of the container 30 that is filled up with a rare-earth alloy powder may be on the order of 10–100 kg, it is preferred to use a lift (not shown) for the movement of the container 30.

FIG. 2 shows, on the left side thereof, the container 30 being connected to the pulverization apparatus system 200 for filling the container 30 with a rare-earth alloy powder from the pulverization apparatus system 200. The pulverization apparatus system 200 will now be described in detail. The illustrated pulverization apparatus system 200 includes a jet mill 70 for performing the pulverization process in a non-oxidative atmosphere with a reduced oxygen concentration, an intermediate hopper 80 for temporarily storing the obtained powder, and a lubricant mixer 90 for mixing and stirring a lubricant into the powder. The jet mill 70, the intermediate hopper 80 and the lubricant mixer 90 are connected to one another by pipes 82 and 84, thus maintaining a closed airtight system. Thus, these units also together form a closed system, whereby the production of a powder and the mixing of the powder with a lubricant can be performed while being blocked from the atmospheric air.

A low-oxygen rare-earth alloy powder is output from the jet mill 70 and passed to the intermediate hopper 80 via the pipe 82 to be stored in the intermediate hopper 80. After a sufficient amount (e.g., 80 kg) of powder has been stored in the intermediate hopper 80, the powder is passed from the intermediate hopper 80 to the lubricant mixer 90 via the pipe 84, and the powder is mixed with a lubricant in the lubricant mixer 90 while being stirred. During the mixing/stirring process, the outlet valve 85 of a pipe 86 is closed. After the empty container 30 is connected to the outlet of the pipe 86, the valve 85 is opened, thereby filling the container 30 with the powder from the intermediate hopper 80.

The container 30 filled with the powder is moved on the floor, and then attached to the top of the compacting apparatus 100 by means of a lift (not shown). The container 30 is then connected to the powder supply device 40 via a connection section 44 to be described later.

Referring back to FIG. 1, after the container 30 is attached to the compacting apparatus 100, the inside of the apparatus is purged with nitrogen gas, thereby forming an inert atmosphere in the apparatus. When a decrease in the oxygen concentration in the apparatus to a predetermined value is detected by an oxygen concentration sensor to be described later, the rare-earth alloy powder is allowed to fall from the container 30 into a material receptacle 42 of the powder supply device 40. The connection section 44 having a valve 44*a* capable of closing the material receptacle 42 is provided between the material receptacle 42 of the powder supply device 40 and the container 30. When the container 30 is detached from the compacting apparatus 100, the valve 44*a* is closed so that the atmospheric air cannot enter the powder supply device 40. The valve 44*a* preferably has a high level of airtightness, and may be a butterfly valve, for example. A nitrogen gas is externally supplied into the connection section 44, whereby a nitrogen atmosphere can be maintained in the powder supply device 40 irrespective of the presence/absence of the container 30. The closed valve 44*a* is opened after the container 30 that is filled with a rare-earth alloy powder is mounted on the compacting apparatus 100, whereby the inside of the container 30 is placed in communication with the inside of the powder supply device 40. In the illustrated example, an upper portion of the connection section 44 is shaped in the form of a bellows, whereby the connection section 44 is airtight and connected to the container 30.

The powder supply device 40 of the present embodiment includes a flexible (for example, rubber) hollow portion 46 that is connected to the feeder box 20, and a non-flexible (for example, metal) hollow portion 48, with a screw feeder being provided in the non-flexible hollow portion 48. A powder is passed through these hollow portions 46 and 48 into the feeder box 20. The flexible hollow portion 46 of the present embodiment has a flexibility such that the it can flexibly deform as the feeder box 20 is moved. More specifically, the flexible hollow portion 46 of the present embodiment may be made of a two-layer hose. As the reciprocation of the feeder box 20 is repeated over a long period of time, the hose may degrade through fatigue and have a minute hole therein. Such a hole may allow oxygen in the atmospheric air to enter the hose, thereby possibly igniting the powder. In the present embodiment, the use of a two-layer hose significantly reduces such a possibility of ignition. Preferably, the inside of an inner hose of the two-layer hose is filled with an inert gas having a pressure higher than that of the atmosphere. More preferably, the space between the inner hose and an outer hose of the two-layer hose is also filled with such an inert gas. When the hose degrades over a long period of time, the hose is replaced by a new hose.

A small vibrating means (for example, a vibrator) 60 is attached to the outside of the hose for vibrating the flexible hollow portion 46 so as to facilitate the falling of the rare-earth alloy powder therethrough.

The non-flexible hollow portion 48 of the powder supply device 40 extends in a generally horizontal direction, and communicates the material receptacle 42 to the flexible hollow portion 46. The rare-earth alloy powder that has fallen from the container 30 into the powder supply device 40 is fed by, for example, the rotation of a screw feeder (not shown) that is provided in the non-flexible hollow portion 48 to the right in the figure, and passes through the flexible hollow portion 46 so as to be supplied into the feeder box 20. An end of the shaft of the screw feeder is connected to a servo motor 62 (FIG. 2) so that the amount of the powder supplied into the feeder box 20 can be controlled with a high precision by adjusting the rotation of the servo motor 62.

In the present embodiment, a nitrogen gas is supplied into the powder supply device 40 at positions respectively on the upstream side (left side in FIG. 1) and downstream side (right side in FIG. 1) of the screw feeder in order to keep the oxygen concentration in the powder supply device 40 at a sufficiently low level. The nitrogen gas supplied into the powder supply device 40 flows out of the apparatus through the bottom of the feeder box 20 while keeping a positive pressure (i.e., a pressure higher than the ambient pressure) in the powder supply device 40.

The powder supply device 40 having such a structure is provided with a one or a more temperature sensors for sensing the temperature of the rare-earth alloy powder therein. If the atmospheric air somehow enters the powder supply device 40 and oxidizes the rare-earth alloy powder, the temperature of the rare-earth alloy powder increases. In view of this, it is possible to quickly detect oxidization of the rare-earth alloy powder and to prevent possible ignition of the powder by constantly (or frequently) measuring the powder temperature in the powder supply device 40. In the present embodiment, a temperature sensor is provided at two positions respectively indicated by arrows C and D in FIG. 1 to sense the temperature of the rare-earth alloy powder at these positions. The temperature sensor may be a contact type sensor or a non-contact type sensor. For example, an infrared temperature sensor or a thermocouple may be used. An additional temperature sensor may be provided upstream of the screw feeder.

In the present embodiment, a valve that is opened or closed in response to an electric signal is provided at both ends of the flexible hollow portion 46, i.e., between the flexible hollow portion 46 and the non-flexible hollow portion 48 and between the flexible hollow portion 46 and the feeder box 20. A control system is provided for closing the valves when the powder surface temperature measured by the temperature sensor exceeds a predetermined temperature (e.g., 50° C.). As a result, when the rare-earth alloy powder ignites in the feeder box 20, for example, the ignition is prevented from expanding to the flexible hollow portion 46 or other areas.

As shown in FIG. 1, the feeder box 20 is a metal container having a generally rectangular parallelepiped shape, and may be opened at the bottom. Other than the bottom portion, the feeder box 20 has an airtight structure. At the retracted position B, the bottom (opening) of the feeder box 20 is closed by a metal base plate 64 of the compacting apparatus 100. Although there is a slight gap between the feeder box 20 and the base plate 64, the atmospheric air is unlikely to enter the feeder box 20 because an inert gas is constantly fed into the feeder box 20.

The feeder box 20 is moved horizontally by a driving device 66 between the powder-filling position A and the retracted position B. The driving device 66 is provided with a servo motor and is capable of reciprocally moving the feeder box 20 in the horizontal direction for a distance of about 1000 mm, for example, through the movement of a rod extending from the driving device 66. As the feeder box 20 reaches the powder-filling position A, a portion of the rare-earth alloy powder in the feeder box 20 falls into the cavity of the die 12 to fill the cavity. Preferably, a stirring device (not shown), e.g., a shaker or an agitator, is provided in the feeder box 20. The stirring device may swing, rotate or reciprocate in the feeder box 20 that has come to a stop, thereby contributing to a uniform and reproducible powder-filling into the cavity. Such a stirring device is disclosed in, for example, Japanese Patent Publication for Opposition No. 59-40560, Japanese Laid-Open Utility Model Publication No. 63-110521 and Japanese Patent Application No. 11-364889. Such a stirring device is also disclosed in copending U.S. patent application Ser. No. 09/472,247, which application is incorporated herein by reference.

If some particles of the rare-earth alloy powder are stuck between the bottom edge surface (metal) of the feeder box 20 and the surface (metal) of the die 12, there is an increased possibility of ignition of the rare-earth alloy powder due to friction and/or exposure to the atmospheric air. In view of this, in the present embodiment, a fluoro-plastic plate (not shown) is attached to the bottom edge surface of the feeder box 20 as a member in order to allow the feeder box 20 to move smoothly while keeping the inside thereof airtight. Moreover, a temperature sensor is provided in the feeder box 20 so as to quickly detect heating and ignition of the powder. The output from the temperature sensor is passed to a control unit (not shown), and if an abnormal temperature is detected in the feeder box 20, the valves provided on both sides of the flexible hollow portion 46 are automatically closed as described above.

As the step of filling the powder into the cavity is repeated over time, the amount of a rare-earth alloy powder 24 in the feeder box 20 gradually decreases, whereby it is necessary to refill the feeder box 20 with rare-earth alloy powder. In a case where the powder is supplied from the feeder box 20 into the cavity through gravity drop, the amount of powder in the feeder box 20 significantly influences the amount of powder filled into the cavity. In the present embodiment, a level sensor 22 (see FIG. 2) is provided in an upper portion of the feeder box 20. The level sensor 22 is used to detect the upper surface level of the rare-earth alloy powder 24 (powder height) in the feeder box 20, thereby externally detecting the amount of powder remaining in the feeder box 20. Thus, it is possible to precisely and efficiently determine the timing and amount of powder supplied into the feeder box 20. In the present embodiment, when the upper surface level of the rare-earth alloy powder 24 in the feeder box 20 has decreased below a predetermined level, a predetermined amount of rare-earth alloy powder is supplied into the feeder box 20 by the powder supply device 40. Alternatively, the level sensor 22 may be provided on the base plate 64, apart from the feeder box 20. In order to precisely detect the upper surface level of the rare-earth alloy powder 24, it is preferred to smooth the upper surface of the powder in the feeder box 20 by activating the stirring device or by moving the feeder box 20 back and forth prior to the detection of the level.

A method of supplying a powder into the feeder box 20 will now be described in detail with reference to FIG. 3A to FIG. 3D.

Figure 3A:
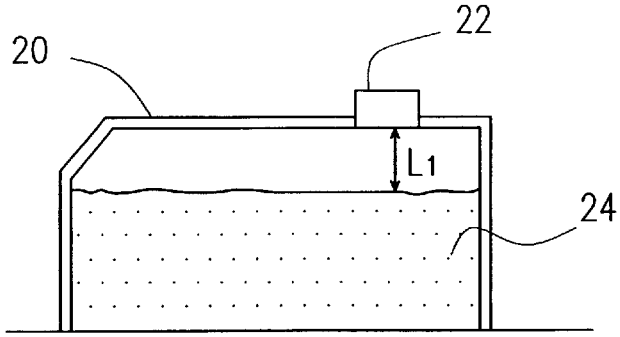
FIG. 3A, FIG. 3B, FIG. 3C and FIG. 3D are cross-sectional views illustrating an operation of supplying a powder into a feeder box 20 according to an embodiment of the present invention.
Figure 3B:
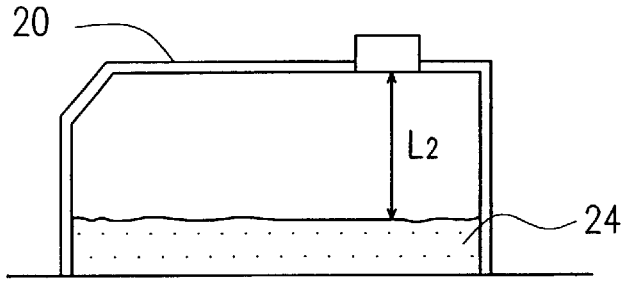

The level sensor 22 used in the present embodiment is a high precision displacement sensor capable of optically measuring with a high precision the distance between the level sensor 22 and the upper surface level of the rare-earth alloy powder 24 in the range from a distance $L_1$ illustrated in FIG. 3A and a distance $L_2$ illustrated in FIG. 3B. The level sensor 22 emits laser light from a light emitting section thereof (not shown) to the powder upper surface, and detects the reflected light at a light receiving section thereof (not shown). The feeder box 20 may have a transparent top portion. The level sensor 22 may be provided on the top portion of the feeder box 20. In this case, the level sensor 22 emits laser light through the transparent top potion of the feeder box 20. When the distance between the level sensor 22 and the upper surface of the rare-earth alloy powder 24 is within the range from $L_1$ to $L_2$ (the measurement range), the level sensor 22 can generate an output (a current or a voltage) having a magnitude in proportion to the distance. Therefore, it is possible to precisely measure the distance between the level sensor 22 and the powder upper surface based on the magnitude of the output from the level sensor 22.

Figure 3C:
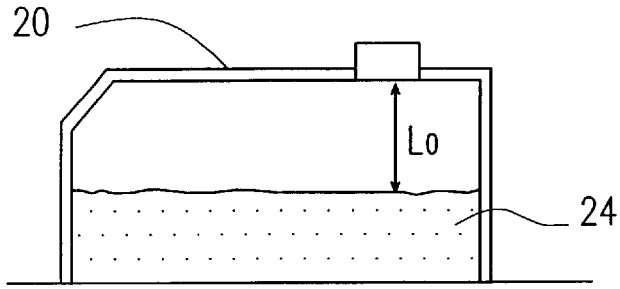

FIG. 3C illustrates the powder 24 whose upper surface is at a mean level within the measurement range. The relationship of $L_0=(L_1+L_2)/2$ holds, wherein $L_0$ denotes the distance between the level sensor 22 and the powder upper surface as illustrated in FIG. 3C.

Figure 3D:
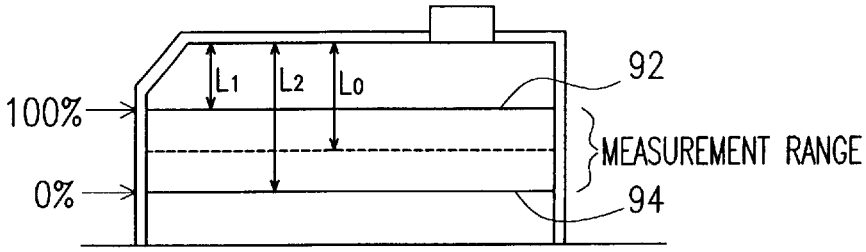

Referring to FIG. 3D, the upper surface level of the powder 24 (referred to also as the "powder height") corresponding to the distance $L_1$ and the powder height corresponding to the distance $L_2$ are expressed as "100%" and "0%", respectively, and the powder height corresponding to the distance $L_0$ is expressed as "50%". With the level sensor 22, it is possible to precisely measure any powder height within the range from 0% to 100%.

In the present embodiment, the powder supply device 40 is controlled so that the powder height is always in the range from 45% to 55%, for example. Therefore, when the powder height decreases from 50% to 47%, for example, as a result of filling the powder into the cavity, a powder is not supplied into the feeder box 20. A powder is supplied into the feeder box 20 when it is determined that the powder height has decreased to 40%, for example.

The amount of powder to be supplied into the feeder box 20 can be determined, for example, as follows.

First, the weight X of an amount of rare-earth alloy powder that is required to fill up the space defined by the measurement range illustrated in FIG. 3D (i.e., the space between a plane 92 and a plane 94) is calculated. Then, the weight Y of an amount of powder supplied for one revolution of the screw feeder is obtained. When the powder height in the feeder box 20 is 40%, the amount S of powder supply into the feeder box 20 that is necessary to increase the powder height from 40% to 50% is expressed by the following expression.

$$S=X\cdot(50-40)/100 \text{ gram (g)}$$

The relationship S=Y ·N holds, wherein N denotes the number of revolutions of the screw feeder. Thus, the number of revolutions of the screw feeder can be obtained from the following expression: N=X·(50–40)/100/Y.

Assuming that the weight X is 10000 g and the weight Y is 200 g, N is 5. This means that rotating the screw feeder for five revolutions will supply 1000 g of powder into the feeder box 20 to increase the powder height therein from 40% to 50%.

If a fixed amount of powder is periodically (for example, each time the powder is filled into the cavity) supplied into the feeder box 20 without using the level sensor 22, the possible slight error between the amount of powder supplied into the feeder box 20 and the amount of powder from the feeder box 20 filled into the cavity accumulates gradually over time, whereby the amount of powder in the feeder box 20 may become insufficient or excessive. In the present embodiment, this is avoided by employing the level sensor 22 to detect the amount of powder remaining in the feeder box 20 so that an appropriate amount of powder is supplied into the feeder box 20 when the remaining amount has decreased below a predetermined level. In this way, the amount of powder in the feeder box 20 will not be significantly shifted from the target value. There is also an advantage that the powder weighing process, which has been necessary in the prior art, is no longer necessary.

While the compacting apparatus 100 controls the powder supply by adjusting the rotation of the screw feeder, the powder supply may alternatively be performed by any other suitable mechanical device. Therefore, the present invention is not limited by the specific structure as described above, but an important point is to utilize a structure through which a powder can be moved without being exposed to the atmospheric air.

As described above, in the present embodiment, a rare-earth alloy powder before being compacted is in a closed system that is substantially blocked from the atmospheric air, and an inert gas is supplied into the closed system. Therefore, the oxygen concentration in the atmosphere along the closed passageway from the container 30 to the feeder box 20 is suppressed to be 50000 volume ppm or less. Because an increase in the oxygen concentration may lead to ignition of the powder, at least one gas concentration sensor for detecting the oxygen concentration in the closed system is provided in the powder supply device 40. Such an oxygen concentration sensor is preferably provided upstream of the screw feeder, for example. The output from the oxygen concentration sensor is passed to a control unit so that when an oxygen concentration over a predetermined value is detected, the valves are electrically closed and the pressing operation is stopped.

When the rare-earth alloy powder in the container 30 is completely consumed, the valve of the connection section 44 is closed for replacement of the container 30. Since the valve of the connection section 44 is kept closed after the container 30 is detached from the compacting apparatus 100, the atmospheric air will not enter the powder supply device 40.

A method of producing a rare-earth magnet using the compacting apparatus as described above will now be described in detail.

Step of Making Rare-earth Alloy Powder

First, an R—Fe—B molten alloy is made, containing 10–30 at % (atomic percent) of R (wherein R denotes at least one rare-earth element and/or Y), 0.5–28 at % of B, and Fe and unavoidable impurities as the reminder. Part of Fe may be substituted with at least one of Co and Ni, and part of B may be substituted with C. According to the present invention, it is possible to reduce the oxygen content and to suppress the production of an oxide of the rare-earth element R for use. Thus, it is possible to minimize the amount of the rare-earth element R.

Next, the molten alloy is solidified by a strip casting method into a ribbon (or thin sheet) having a thickness of 0.03–10 mm. The molten alloy is cast into a cast piece having a structure where the R-rich phase portions are separated by a minute interval of 5 $\mu$m or less, and then the cast piece is contained in a vacuum container. After the container is evacuated, an $H_2$ gas having a pressure of 0.03–1.0 MPa is supplied into the container to provide a disintegrated alloy powder. The disintegrated alloy powder is subjected to a dehydrogenation process, and then finely pulverized in an inert gas flow.

The cast piece to be a magnet material used in the present invention may be suitably produced from a molten alloy of a particular composition by using a strip casting method such as a single chill roll method or a dual chill roll method. Whether to use a single chill roll method or a dual chill roll method may be determined based on the thickness of the cast piece to be made. When the thickness of the cast piece is large, a dual chill roll method is preferred, and when it is small, a single chill roll method is preferred.

When the thickness of the cast piece is less than 0.03 mm, the rapid cooling effect becomes substantial, whereby the crystal grain size may become excessively small. If the crystal grain size is excessively small, the individual particles may turn into polycrystal as they are turned into powder, whereby a uniform crystal orientation cannot be given, thus deteriorating the magnetic properties. Conversely, if the thickness of the cast piece exceeds 10 mm, the cooling rate is reduced, whereby $\alpha$-Fe is likely to crystallize and the Nd-rich phase may be localized.

A hydrogen occlusion process can be performed, for example, as follows. After a cast piece is broken into smaller pieces of a predetermined size and placed in a material case, the material case is inserted into a hydrogen furnace that can be closed in an airtight manner. After the hydrogen furnace is closed, the hydrogen furnace is sufficiently evacuated and a hydrogen gas having a pressure of 30 kPa–1.0 MPa is supplied into the furnace so as to allow the cast strip to occlude hydrogen. Since the hydrogen occlusion reaction is exothermic, a cooling pipe through which a coolant water is supplied is preferably provided around the furnace so as to prevent the temperature in the furnace from increasing. The cast piece naturally disintegrates into coarse powder by the hydrogen occlusion process.

The obtained powder alloy is cooled, and is subjected to a dehydrogenation process in a vacuum. Since the coarse alloy powder obtained through a dehydrogenation process have minute cracks therein, the alloy powder can be finely pulverized in a subsequent step using a ball mill, a jet mill, or the like, within a short period of time, thereby obtaining an alloy powder having a particle size distribution as described above. A preferred embodiment of a hydrogen pulverization process is disclosed in Japanese Laid-Open Patent Publication No. 7-18366, for example.

The fine pulverization is preferably performed by a jet mill using an inert gas (e.g., $N_2$ or Ar) as illustrated in FIG. 2. In the present embodiment, the fine pulverization is performed by using the jet mill 70 of FIG. 2. It is preferred to control the oxygen concentration in the atmosphere gas in the jet mill 70 to a low level (e.g., 5000 volume ppm or less) so as to suppress the amount of oxygen contained in the powder (e.g., 4000 mass ppm or less).

It is preferred to add a liquid lubricant whose main component is a fatty acid ester to the material alloy powder. In the present embodiment, the addition of a lubricant is performed by using the lubricant mixer 90. The mixer 90 may be a stirring type mixer, for example. A preferred amount of lubricant to be added is 0.05–5.0 weight %, for example. Specific examples of the fatty acid ester include methyl caproate, methyl caprylate, methyl laurylate, methyl laurate, and the like. The lubricant may additionally include a binder component. An important point is that the lubricant can be removed through volatilization in a subsequent step. When the lubricant is a solid lubricant that is difficult to be uniformly mixed with the alloy powder, the lubricant may be diluted with a solvent. Specific examples of the solvent include a petroleum solvent such as isoparaffin, a naphthenic solvent, and the like. The lubricant may be added at any timing, i.e., before the fine pulverization, during the fine pulverization or after the fine pulverization. The liquid lubricant covers the surface of the powder particles, providing an effect of preventing the oxidization of the particles while making uniform the density of the compact that is obtained from a pressing step, thereby suppressing the disturbance in the magnetic alignment of the powder particles. A dry powder as used herein refers to a powder that does not necessitate the process of squeezing out the liquid during a compacting step, and includes a powder to which a liquid lubricant has been added as described above.

Pressing Step

Then, the powder made by the pulverization apparatus system 200 illustrated in FIG. 2 is subjected to a compaction process by using the compacting apparatus 100 illustrated in FIG. 1.

First, a rare-earth alloy powder is supplied from the pulverization apparatus system 200 into the airtight container 30 without exposing the rare-earth alloy powder to the atmospheric air. After the container 30 is set in a predetermined position of the compacting apparatus 100, the nitrogen supply into the connection section 44, the powder supply device 40 at positions respectively upstream and downstream of the screw feeder, and the feeder box 20 is started, thereby substituting the air atmosphere remaining in the apparatus with a nitrogen atmosphere. After a decrease in the oxygen concentration in the atmosphere below a predetermined level is detected by the oxygen concentration meter provided upstream of the screw feeder, the valve of the connection section 44 and the valves at both ends of the flexible hollow portion 46 are opened, and the screw feeder is rotated. As a result, an intended amount of rare-earth alloy powder is supplied from the material receptacle 42 into the feeder box 20. As the screw feeder is rotated for a predetermined number of revolutions, a measured amount of powder is supplied into the feeder box 20. Upon completion of the supply of powder, the feeder box 20 is moved back and forth for a short distance at the retracted position B and the shaker is activated so as to smooth the powder that has been supplied into the feeder box 20. Then, the powder height is measured by the level sensor 22.

By repeating the above-described operation, a sufficient amount of powder is stored in the feeder box 20, after which a known pressing operation by dry compacting method (i.e. the method for compacting a dry powder) is started. In the pressing operation, the die 12 is lifted to a position illustrated in FIG. 1 and a cavity is formed, after which the feeder box 20 is moved by the driving device 66 to the powder-filling position A to allow the powder to be gravity fed into the cavity. As the feeder box 20 is moved back to the retracted position B, a portion of the powder above the upper cavity plane is leveled by the bottom edge of the feeder box 20, thereby filling a predetermined amount of powder into the cavity. The density at which to fill the powder into the cavity is determined within a range such that the powder particles can be aligned in a magnetic field and the alignment of the magnetic powder particles is less likely to be disturbed after removal of the magnetic field. In the present embodiment, the filling density is preferably 10–40% of the density of the sintered body (i.e., the density ratio is preferably 10–40%), for example.

After the feeder box 20 has returned to the retracted position B, the level sensor 22 measures the height of the powder remaining in the feeder box 20. When the powder height is below a predetermined range, the screw feeder is rotated to supply a predetermined amount of powder into the feeder box 20.

While the feeder box 20 is moved back to the retracted position B and a powder is supplied into the feeder box 20 as necessary, the pressing step is performed. In the pressing step, the upper punch 14 is lowered to close the cavity space, after which an aligning magnetic field is applied through the powder in the cavity, and the distance between the upper punch 14 and the lower punch 16 is reduced, while aligning the powder particles in the magnetic field, to compact the powder. After a compact of the rare-earth alloy powder is made as described above, the upper punch 14 is lifted and the die 12 is lowered for taking the compact out of the die 12.

If an abnormality is detected by the temperature sensor or the oxygen concentration sensor during the pressing operation as described above, the valve of the connection section 44 and the other valves provided at other positions are closed, and the pressing operation is stopped. Then, the danger of ignition is eliminated by an operator, for example, and the pressing operation is resumed.

The compact made by the compacting apparatus 100 is preferably subjected to an impregnation process with an oil agent such as an organic solvent immediately after it is clamped and taken out of the die 12 by a robot arm, or the like. Since the compact immediately after the compaction process generates heat and is highly active, the impregnation process is performed to prevent the ignition of the compact. In the present embodiment, a saturated hydrocarbon solution such as isoparaffin may be used as a solvent with which to impregnate the compact. The organic solvent is put into a solution vessel, and the compact is immersed into the organic solvent in the solution vessel. The surface of the compact taken out of the organic solvent is impregnated with a saturated hydrocarbon solution so that the direct exposure of the compact to oxygen in the atmospheric air is suppressed. As a result, the possibility of the heating and ignition of the compact within a short period of time is significantly reduced even if the compact is left in the atmospheric air. As the time for immersing the compact into the organic solvent (immersion time), a period of time equal to or greater than 0.5 second is sufficient. Although the amount of organic solvent in the compact increases as the immersion time increases, this will not cause a problem such as breaking the compact. Therefore, the compact may be kept immersed in the organic solvent or the impregnation step may be repeated for a number of times before starting the sintering step. Such a method of preventing a compact from being oxidized is disclosed in copending U.S. patent application Ser. No. 09/702,130, which application is incorporated herein by reference.

The organic solvent for use in the impregnation process may be a liquid lubricant to be added to the powder for the purpose of improving the alignment and compactiblility of the powder particles during a pressing process. However, the organic solvent should have a surface oxidization preventing function. Therefore, it is particularly preferred to use a petroleum solvent such as isoparaffin, a naphthenic solvent, a fatty acid ester such as methyl caproate, methyl caprylate, methyl laurylate and methyl laurate, a higher alcohol, a higher fatty acid, etc.

After the impregnation process, the compact is made into a final permanent magnet product through known production processes such as the binder removing step, the sintering step, the aging process step, and the like. The oil agent with which to impregnate the compact may be selected from among those that will be separated from the compact during the binder removing step and the sintering step. Therefore, the oil agent will give no adverse influence on the magnetic properties. After volatilization of the oil agent in the binder removing step before sintering, or the like, it is necessary to keep the compact under an environment with a low oxygen concentration without exposing the compact to the atmospheric air. Therefore, it is preferred that the furnace for the binder removing step and the furnace for the sintering step are connected to each other so that the compact can be moved between the furnaces without being exposed directly to the atmospheric air. It is desirable to use a batch furnace for these steps.

While a material alloy is made by a strip casting method in the present embodiment, any other appropriate method can alternatively be used (e.g., an ingot method, a direct reduction method, or an atomization method).

Moreover, while the present invention has been described above with respect to a rare-earth alloy powder having a low oxygen concentration and thus a high possibility of ignition, the present invention is not limited to this. Because a rare-earth alloy powder tends to deteriorate its magnetic properties through oxidization irrespective of the level of oxygen concentration therein, the present invention in which the powder is supplied into the feeder box through a closed passageway without being exposed to the atmospheric air is very useful in producing a rare-earth magnet with desirable magnetic properties.

According to the present invention, it is possible to avoid the heating and ignition of even a rare-earth alloy powder that is easily oxidized. Therefore, it is possible to safely and practically increase the amount of the major phase of a magnet, thereby significantly improving the magnetic properties of a rare-earth magnet.

Particularly, with the compacting apparatus of the present invention, it is not necessary to place the apparatus itself in a room that is kept in an inert atmosphere. Therefore, an operator can safely monitor the pressing operation and make an inspection on the apparatus.

Moreover, it is possible to ensure safety during the production of a rare-earth magnet and to stabilize the quality of the magnet.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention that fall within the true spirit and scope of the invention.

We claim:

1. A method of producing a rare-earth magnet by performing a compaction process comprising the steps of:

supplying a powder compacting apparatus comprising an airtight container capable of storing a rare-earth alloy powder therein, an airtight feeder box movable between a powder-filling position and a retracted position, and an airtight powder supply device adapted to supply the rare-earth alloy powder from said container into said feeder box without exposing the rare-earth alloy powder to an atmospheric air;

storing a rare-earth alloy powder in said container;

operating said powder supply device to supply the rare-earth alloy powder from said container into said feeder box without exposing the rare-earth alloy powder to atmospheric air; and compacting the rare-earth alloy powder supplied from said feeder box, thus producing a compact.

2. The method of claim 1, wherein the rare-earth alloy powder contains 4000 mass ppm or less oxygen content.

3. The method of claim 1, further comprising the steps of:

impregnating said compact with an oil agent; and sintering the compact.

4. The method of claim 1, further comprising the step of mixing the rare-earth alloy powder with a lubricant.

5. The method of claim 1, wherein the rare-earth alloy powder is a dry powder.

6. A method of producing a rare-earth magnet, comprising the steps of:

producing a rare-earth alloy powder through pulverization by a pulverization apparatus in which an oxygen concentration in a pulverization atmosphere is controlled to be 5000 volume ppm or less;

supplying the rare-earth alloy powder into an airtight container without exposing the rare-earth alloy powder to atmospheric air;

transferring the rare-earth alloy powder from the container into an airtight feeder box without exposing the rare-earth alloy powder to atmospheric air;

filling from the feeder box the rare-earth alloy powder into a cavity formed in a die of a compacting apparatus; and forming a compact by pressing the rare-earth alloy powder.

7. The method of claim 6, wherein said step of transferring the rare-earth alloy powder from the container into the feeder box is effected using a hollow structure having an inert atmosphere therein.

8. The method of claim 6, wherein said step of forming a compact is performed in an air atmosphere.

* * * * *